United States Patent [19]

Kobayashi et al.

[11] Patent Number: 4,789,260

[45] Date of Patent: Dec. 6, 1988

[54] THERMAL PRINTER

[75] Inventors: Hiroshi Kobayashi, Iwate; Yuji Nagahamaya, Takizawa; Kazuo Ueda, Tamayama; Ikuo Hibino, Takizawa, all of Japan

[73] Assignee: Alps Electric Co., Ltd., Japan

[21] Appl. No.: 84,907

[22] Filed: Aug. 13, 1987

[30] Foreign Application Priority Data

Oct. 8, 1986 [JP] Japan ..... 61-239841
Nov. 17, 1986 [JP] Japan ..... 61-273778
Dec. 9, 1986 [JP] Japan ..... 61-190244[U]

[51] Int. Cl.[4] ..... B41J 3/10; B41J 29/16
[52] U.S. Cl. ..... 400/697.1; 400/120
[58] Field of Search ..... 400/197-199, 400/120, 696, 696.1

[56] References Cited

U.S. PATENT DOCUMENTS 4,268,368 5/1981 Aviram et al. ..... 400/197
4,384,797 5/1983 Anderson et al. ..... 400/696
4,396,308 8/1983 Applegate et al. ..... 400/696
4,421,429 12/1983 Graham ..... 400/198
4,504,840 3/1985 Evans et al. ..... 400/197
4,561,793 12/1985 Blanchard, Jr. ..... 400/696.1
4,651,162 3/1987 Nakamura et al. ..... 400/120
4,700,200 10/1987 Hibino ..... 400/696

FOREIGN PATENT DOCUMENTS 49290 3/1983 Japan ..... 400/199
57972 4/1983 Japan ..... 400/198
91086 5/1984 Japan ..... 400/198

*Primary Examiner*—William Pieprz
*Attorney, Agent, or Firm*—Guy W. Shoup; Paul J. Winters

[57] ABSTRACT

A thermal printer includes a thermal head and a printing and erasing common-use ribbon. The thermal head is configured to move during erasing operation in a direction opposite to that during printing operation so as to reuse for subsequent printing operation a portion of the ribbon once used for preceding erasing operation.

4 Claims, 5 Drawing Sheets

(a)

(b)

THERMAL PRINTER

FIELD OF THE INVENTION

This invention relates to a thermal printer, and more particularly to an improved thermal printer configured to print and erase letters and suitable for use in a work processor or typewriter.

BACKGROUND OF THE INVENTION

Some of prior art thermal printers are configured to print and erase letters, using printing and erasing common-use ribbon interposed between printing paper and a head, as disclosed in U.S. Pat. No. 4,384,797.

However, since there has been no idea to print a letter, reusing a portion of the ink ribbon once used to erase an erroneous letter, different portions of the ink ribbon must be used for printing operation and erasing operation. This apparently accelerates consumption of ink ribbon, and frequent exchange of ink ribbon cassettes increases the running cost of the word processor or typewriter.

Additionally, the prior art thermal printer requires a movable ribbon guide to change the timing for stripping the ribbon from the paper between printing operation and erasing operation, and this invites a complicated structure of the printer.

OBJECT OF THE INVENTION

It is therefore an object of the invention to provide a thermal printer which saves consumption of thermal printing ribbon.

A further object of the invention is to provide a thermal printer having a simplified mechanism and effecting both printing and erasing operations.

SUMMARY OF THE INVENTION

The invention is characterized in that a portion of a thermal printing ribbon once used for preceding erasure is used again for subsequent printing, and that a thermal head during erasing operation is moved in the opposite direction to that during printing operation.

The common use of the thermal printing ribbon in erasing and printing operations contributes to a less consumption of the ribbon. Additionally, since the thermal head itself may be configured to serve as a ribbon guide during erasing operation, so as to omit a movable ribbon guide which has been indispensable in prior art printers of this type.

BRIEF DESCRIPTION OF THE DRAWINGS

The drawings all illustrate preferred embodiments of the invention in which.

DETAILED DESCRIPTION

Figure 1:
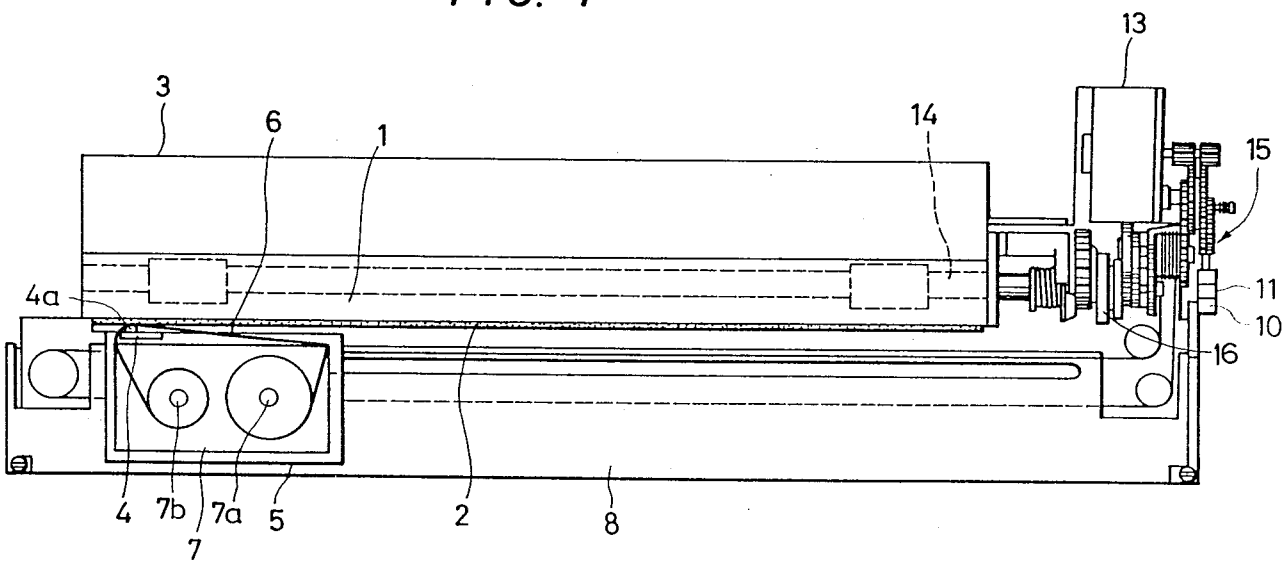
FIG. 1 is a plan view showing a general arrangement of a thermal printer.

The invention is described below, referring to some preferred embodiments illustrated in the drawings.

Figure 2:
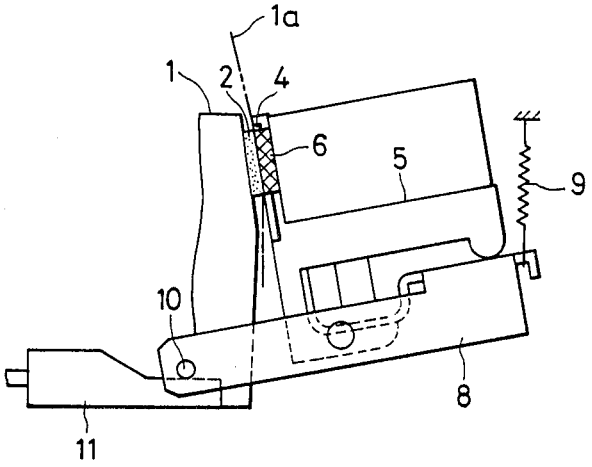
FIGS. 2(*a*) and 2(*b*) are side elevations of the arrangement of FIG. 1.
Figure 2:
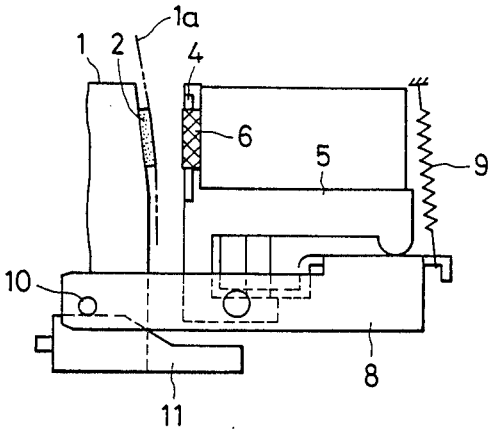

FIG. 1 is a plan view showing a general arrangement of a thermal printer according to an embodiment of the invention, and FIGS. 2(*a*) and (*b*) are side elevations showing different operative configurations of the arrangement of FIG. 1.

In these drawings, reference numeral 1 refers to a platen, 2 to a platen rubber sheet defining the printing position, and 1*a* to a sheet of printing paper supported on the platen 1 and the platen rubber 2. Reference numeral 3 denotes a paper guide which guides the paper 1*a* along the platen rubber 2. Reference numeral 4 designates a thermal head opposed to the platen rubber 2 and includes multiple heater elements 4*a*. The thermal head 4 is supported on a carriage 5 movable in the right and left direction in FIG. 1 along the platen 1. A thermal printing ribbon 6 which is described in detail later is provided with hot-melt ink and interposed between the thermal head 4 and the paper 1*a*. The thermal printing ribbon 6 tightly spans between take-up bobbins 7*a* and 7*b* provided in a ribbon cassette and attached to the carriage 5.

The carriage 5 is movably supported on a carriage support member 8 which itself is pivotable with respect to the platen 1 and biased counterclockwisely by a spring 9 as shown in FIG. 2(*a*). The carriage support member 8 is provided with a pin 10 at one end near the platen 1. The pin 10 engages a cam 11.

Still referring to FIG. 1, reference numeral 13 designates a drive source, i.e. a pulse motor. Rotation of the pulse motor 13 is transmitted by a train of gears 15. The rotation of the motor transmitted by the gear train 15 is selectively transmitted by a clutch mechanism to a mechanism for moving the carriage 5 and to a mechanism for rotating a paper feeding shaft 14.

The cam 11 shown in FIGS. 2(*a*) and (*b*) is configured to move to the right and left in the same drawings, in response to rotation of the pulse motor 13.

Figure 3:
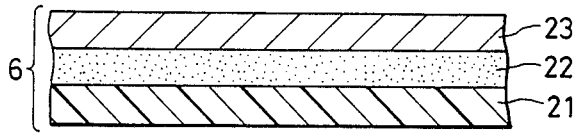
FIG. 3 is a partial, enlarged, cross-sectional view showing a general composition of a thermal printing ribbon.

The thermal printing ribbon 6 has a general arrangement shown by an enlarged cross-sectional view in FIG. 3. That is, the thermal printing ribbon 6 has a three-layer structure consisting of a base film 21 made from heat-resistant resin such as polyethylene terephthalate (PETP), a separation layer 22 made from thermoplastic resin, and an ink layer 23 including carbon black or other colorant and binder and having the softening point lower than that of the separation layer 22. With this arrangement of the thermal printing ribbon 6, when it is detached from the paper 1*a* while the ink layer 23 and the separable layer 22 are melted, the ink layer 23 remains on the paper 1*a* in the form of a printed letter. However, if the ink layer 23 and the separable layer 22 on the paper are stripped after they are cooled and hardened, transfer or printing is not effected on the paper 1*a* even though they have once been attached to the paper 1*a* in their hot-melt condition. This means that printing and erasing operation may be effected, using a single thermal printing ribbon 6.

To activate the thermal printer for either printing or erasing or operation, the pulse motor 13 shown in FIG. 1 is energized to drive the gear train 15 and clutch mechanism 16. Thereby, the paper feeding shaft 14 is rotated to set the paper 1*a* at the printing position. At this time, as shown in FIG. 2(*b*), the pin 10 provided on the carriage support member 8 engages a higher portion of the cam 11 against the energy of the spring 9, so that the thermal head 4 is held apart from the platen rubber 2. In this configuration, any movement of the carriage 5 does not cause printing operation nor ribbon take-up operation.

However, when the pulse motor 13 is activated in this configuration, the cam 11 is moved to the left in FIG. 2(*b*) via the gear train 15 and brings the pin 10 into contact with a lower portion of the cam 11 as shown in FIG. 2(*a*). Due to this, the carriage support member 8 is rotated in the counterclockwise direction so that the thermal head 4 closely contacts the platen rubber 2, sandwiching the paper 1*a* therebetween. Thus, the printer is ready for printing operation or erasing operation with respect to the paper 1*a*.

To establish the configuration for printing or erasing operation, the clutch mechanism is changed to transmit the rotation of the pulse motor 13 to the carriage moving mechanism via the gear train 15 to move the carriage 5 along the platen rubber 2.

Although it is not illustrated, while the thermal head 4 contacts the platen rubber 2, driving power is transmitted via a clutch or other appropriate means to one of the ribbon take-up bobbins 7*a* and 7*b*. That is, when the thermal head 4 moves to the right in FIG. 1, the bobbin 7*b* rotates so as to tightly span the thermal printing ribbon 6, whereas the bobbin 7*a* does so with leftward movement of the thermal head 4.

Figure 4:
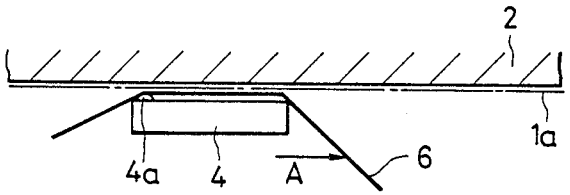
FIG. 4 is a view for explanation of printing operation.

To effect a printing operation in the stand-by configuration in FIG. 2(*a*), the thermal head 4 is moved in arrow A direction as shown in FIG. 4, with its end remote from the heater elements 4*a* preceding its remainder, and prints letters on the paper 1*a*. The thermal printing ribbon 6 heated by the heater elements 4*a* is detached soon from the paper 1*a* at an end portion of the thermal head 4. Therefore, the ink layer 23 and the separation layer 23 of the thermal printing ribbon 6 are still melted, and transfer or printing of letters on the paper 1*a* is effected in this state.

Figure 5:
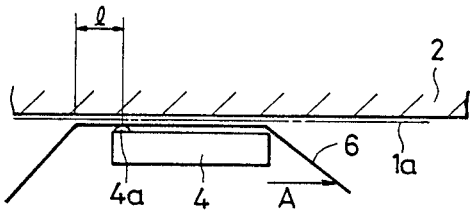
FIG. 5 is a view for explanation of erasing operation.

To erase printed letters, the thermal head 4 is moved in the same direction (arrow A direction) as that for printing operation, with the end thereof remote from the heater elements 4*a* preceding its remainder, as shown in FIG. 5. In this case, however, the thermal printing ribbon 6 is compressed against the paper 1*a* by a movable ribbon guide (not shown) at a position behind the thermal head 4. In this motion, the thermal head 4 heats and melts the separation layer 22 and the ink layer 23 of the thermal printing ribbon 6. Therefore, the ink layer on the ribbon 6 are attached to the ink layer on the paper. The separation layer 22, however is distant by l from the heater elements 4*a*, and it is cooled and hardened with time. Therefore, when the thermal printing ribbon 6 is stripped from the paper 1*a*, both ink layers 23 are united to the thermal printing ribbon 6. In this fashion, lift-off erasure is performed.

Figure 6:
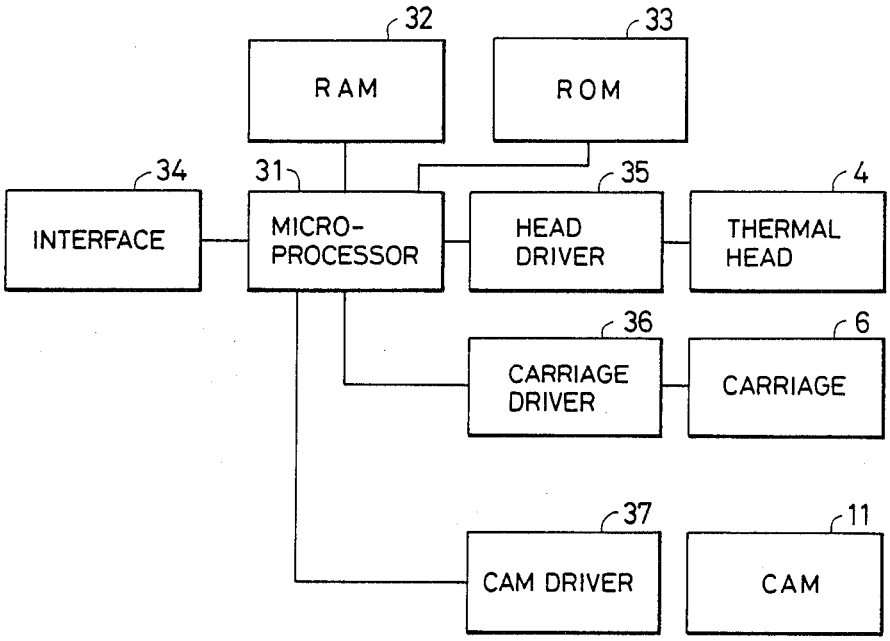
FIG. 6 is a block diagram of a control circuit for controlling various mechanisms.

FIG. 6 shows a block diagram of a control circuit which controls various structures of the thermal printer.

In FIG. 6, reference numeral 31 denotes a known microprocessor which totally controls the thermal printer. To the microprocessor 31 are connected a RAM (random-access memory) 32 storing recording data, etc. and a ROM (read-only memory) 33 storing a control program and others. The microprocessor 31 is connected to an exterior computer or other host equipment via an interface 34. Further, a head driver 35 for driving the heater elements 4*a* of the thermal head 4, a carriage driver 36 for driving the carriage 6 to move the thermal head 4 and a driver 37 for driving the cam 11 to compress or detach the thermal head 4 with respect to the paper 1*a* are connected to the microprocessor 31.

With this arrangement, the microprocessor 31 performs its control operation according to the control program stored in the ROM 33. That is, in receipt of printing or erasing data from the host equipment, the microprocessor 31 uses the RAM 32 for temporary storage of the data, and controls the drivers 35 and 36 and other drivers to effect printing or erasing operation.

In the above-described embodiment, after a misprint erasing operation is finished, the thermal head 4 is moved to a position for printing a correct letter while maintaining its contact with the platen rubber 2. This means that the thermal printing ribbon 6 is transported in the opposite direction and taken up by the take-up bobbin 7*a* by an amount used for the preceding erasure, and that the portion of the thermal printing ribbon 6 once used for the erasure is used again for a subsequent printing operation.

Figure 7:
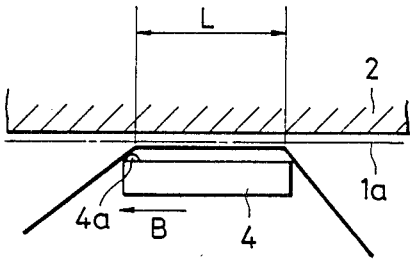
FIG. 7 is a view for explanation of erasing operation effected by a further embodiment of the invention.

A further embodiment of the invention is described below, referring to FIG. 7.

The second embodiment is based on a principle basically identical to that of the thermal printer according to the first embodiment. A difference is that the thermal head 4 is moved in the different directions in printing operation and erasing operation. More specifically, the second embodiment is configured to move the thermal head 4 in arrow A direction in FIG. 4 as in the first embodiment during printing operation. However, it is moved in arrow B direction in FIG. 7 for erasing operation. In this fashion, the thermal head 4 itself serves as the movable ribbon guide used in the first embodiment (but not shown), so that the thermal printing ribbon 6 is stripped from the paper 1*a* at a position distant by the head length L from the heater elements 4*a*. Therefore, the separation layer 22 is already cooled and hardened when the ribbon 6 is detached from the paper 1*a*, and the same lift-off erasure is performed.

Since the thermal head 4 is moved in the opposite directions in printing operation and erasing operation, the thermal ribbon 6 is wound up on the take-up bobbin 7*a* during erasing operation whereas it is wound up on the take-up bobbin 7*b* during printing operation. In this fashion, by simply resuming subsequent printing operation of a correct letter just after the preceding erasure is completed, the portion of the thermal printing ribbon 6 once used for the preceding erasure is used again for the subsequent printing operation.

Figure 8:
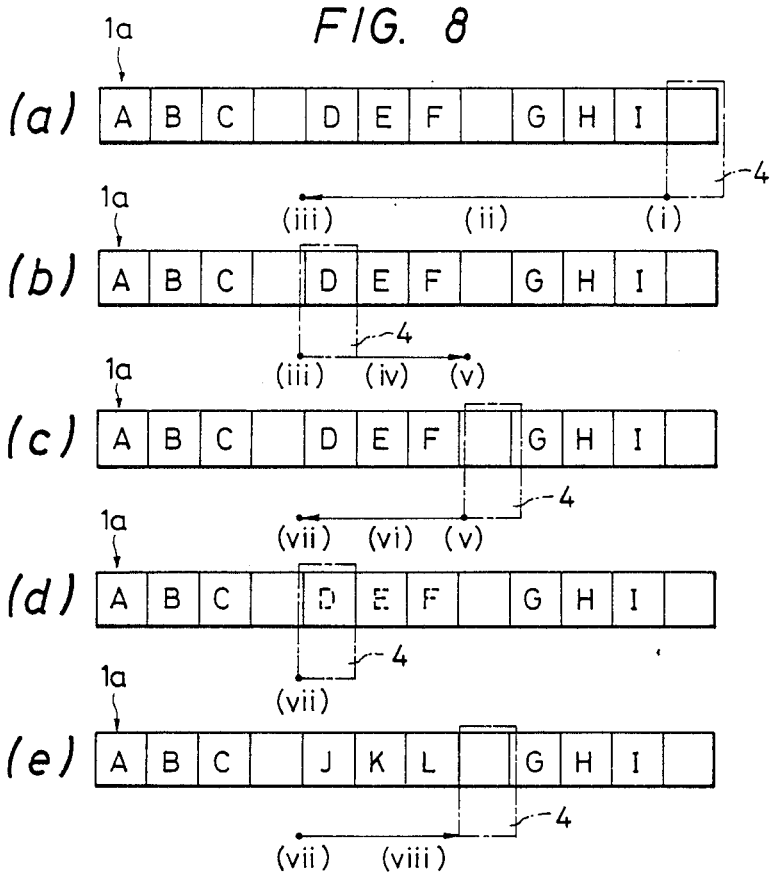
FIG. 8 is a view for explanation of different steps in erasing and printing motion of the same thermal printer.

An embodiment concerning to the aforegoing erasing method is described below in detail, referring to FIG. 8. FIG. 8 shows at (a), (b), (c), (d) and (e) different steps of erasing and printing motion of the thermal printer.

Assume here that an operator of the thermal printer once printed "ABC DEF GHI", recognized that "DEF" is an error, and is now going to erase "DEF" and insert "JKL". First of all, the thermal head 4 is lifted up from the paper 1*a* as shown in FIG. 2(*b*) at position (i) where printing operation of letter "I" is finished. After this, the thermal head 4 is moved in arrow (ii) direction and stopped at position (iii) which is the initial position or a slightly lefthand position of letter "D" (FIG. 8(*a*)). At position (iii), the thermal head 4 is pivoted down to the paper 1*a* as shown in FIG. 2(*a*) to closely sandwich the ink ribbon 6 between them. Subsequently, the thermal head 4 is moved in arrow (iv) direction up to position (v) beyond three letters "DEF" to be erased (FIG. 8(*b*)). Due to this, an amount of unused portion of the ink ribbon 6 corresponding to the movement amount of the thermal head 4 is fed out from the take-up ribbon 7*a*. Although it is not illustrated, while the thermal head 4 is pivoted down, driving force is selectively transmitted to one of the take-up bobbins 7*a* and 7*b* in the ribbon cassette 7 by a clutch mechanism or other means. That is, when thermal head 4 moves to the right (in the printing direction) in FIG. 1, the take-up bobbin 7*b* is rotated to wind up and tightly span the ink ribbon 6. On the other hand, when the thermal head 4 moves to the left (in the erasing direction), the take-up bobbin 7*a* does so. Subsequently, the thermal head 4 is moved back in arrow (vi) direction from position (v) beyond three letters "DEF", and at the same time, the heater elements 4*a* of the thermal head 4 are activated to generate heat so that the ink in the form of letters "DEF" on the paper 1*a* adheres to the ink layer 21 of an unused portion of the ink ribbon 6 fed out by the preceding operation (FIG. 7(*c*)). As described above, it is one of indispensable conditions of erasure to strip the ink ribbon 6 from the paper 1*a* after the ink ribbon 6 is cooled enough to harden the separation layer 22. In this embodiment, since the thermal head 4 moves during erasing operation in the direction opposite to that during printing operation, the portion of the ink ribbon 6 heated and adhered to the letter to be erased is compressed to the paper 1*a* by the thermal head 4 and does not separate from the paper 1*a* until the thermal head 4 further moves to a position where the other end of the thermal head 4 reaches the letter to be erased. That is, during this time, the ink ribbon 6 is cooled enough to harden the separation layer 22. Therefore, when the ink ribbon 6 is stripped from the paper 1*a* at the other end of the thermal head 4, the ink in the form of the letter to be erased is removed from the paper 1*a* together with the ink ribbon 6. In this fashion, erasure is finished. As to the heating method of the heater elements 4*a*, the letter to be erased may be stored so that only some of the heater elements 4*a* corresponding to the letter to be erased are activated, or alternatively, all the heater elements 4*a* may be activated, not storing the letter to be erased. After erasing the letters "DEF" in the aforegoing operation, the thermal head 4 stands at position (vii) where the erased letter "D" existed, in order to subsequently print correct letters "JKL" from here (FIG. 7(*d*)). In this state, the head 4 may be lifted up from the paper 1*a*, and the paper 1*a* may be moved to a position where the operator can confirm the erasure. To print letters "JKL", the thermal head 4 is pivoted down to the paper 1*a* as in a normal printing operation, and is moved in arrow (viii) direction (FIG. 7(*e*)).

Figure 9:
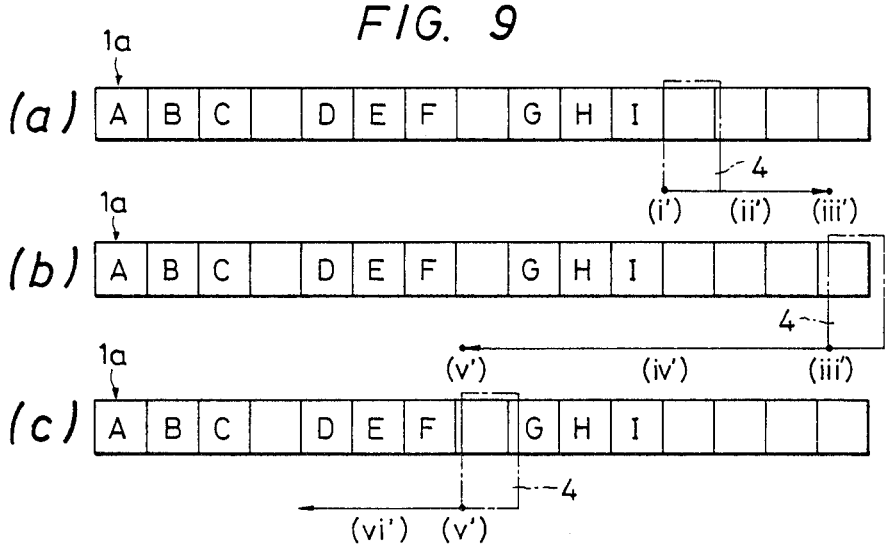
FIG. 9 is a view for explanation of different steps in erasing and printing motion of a thermal printer according to a still further embodiment of the invention.

A still further embodiment is described below, referring to FIGS. 9(*a*), (*b*) and (*c*). Assume again that an operator of the thermal printer once printed "ABC DEF GHI" on the paper 1*a*, and is now going to erase "DEF". First of all, the thermal head 4, while pivoted down and not generating heat, is moved from position (i') where printing of letter "I" is finished, in arrow (ii') direction up to position (iii') beyond three letters "DEF" (FIG. 9(*a*)). Due to this, the ink ribbon 6 is also transported by the same amount of an unused portion thereof. Subsequently, at position (iii'), the thermal head 4 is moved in arrow (iv') direction up to position (v') adjacent to the right end of letter "F" (FIG. 9(*b*)). At position (v'), the thermal head 4 is pivoted down again to the paper 1*a*. After this, the thermal head 4, while generating heat, is moved in arrow (vi') direction as in the preceding embodiment, so that an unused portion of the ribbon 6 transported in the preceding operation adheres to the ink on the paper 1*a* in the form of letters, to remove or erase the letters from the paper 1*a* (FIG. 9(*c*)).

Any artisan in this field will understand that the invention is not limited to the described embodiments, and that various changes or modifications may be employed without departing from the scope of the invention.

Since the invention having the above-described arrangements and functions enables the reuse of thermal printing ribbon at a portion thereof once used to erase a printed letter, it reduces the running cost of a thermal printer, by saving the consumption of thermal printing ribbon. Further, printing and erasing operations are effected by a simple mechanism.

What is claimed is:

1. In a thermal printer having a platen on which a paper is supported, a carriage mounting a thermal head thereon which is movable forwardly and backwardly along a first direction in parallel with the platen, carriage moving means for moving the carriage forwardly and backwardly along the platen in the first direction, said thermal head being movable toward the platen and away from the platen so as to press the thermal head in contact with the paper in a printing position against the platen and to move the thermal head to a standby position away from the paper, respectively, head moving means for moving the thermal head toward and away from the platen, an ink ribbon provided between the thermal head and the paper on the platen, said ink ribbon having a layer of thermally meltable ink facing the paper and being wound in an ink cartridge supported on the carriage, and ribbon winding means for winding the ink ribbon forwardly to bring a fresh portion of the ribbon to the printing position in conjunction with movement of the carriage forwardly along the platen when the thermal head is in the printing position against the platen, the improved method of operating said thermal printer to perform lift-off erasing while reducing consumption of the ink ribbon, comprising the steps of:

providing a thermal head having a length extending in the first direction with an unoccupied end disposed forwardly in the first direction and an occupied end disposed backwardly in the first direction, and thermal heating elements at the occupied end of the thermal head, wherein the ink ribbon has a ribbon portion disposed across the length of the thermal head and is led toward respective parts of the ink cartridge from around the occupied and unoccupied ends of the thermal head;

stopping the forward movement of the thermal head after printing on the paper when it is desired to erase a previously printed ink mark at an erasing position backwardly from the stopped position of the thermal head;

first moving the thermal head backwardly to the erasing position while providing a fresh portion of the ink ribbon in front of the thermal heating elements at the occupied end of the thermal head;

applying heat to the thermal heating elements across the erasing position of the previously printed ink mark, so as to thermally melt the ink layer at the fresh portion of the ink ribbon with the previously printed ink mark;

continuing to move the thermal head backwardly so that the unoccupied portion of the thermal head is moved backwardly of the erasing position without moving the fresh portion relative to the erasing position, during which time the ink layer at the fresh portion is allowed to cool and after which the ink mark becomes adhered to and lifted off from the paper by separation of the ribbon portion from around the unoccupied end of the thermal head; and finally moving the thermal head forwardly to bring the thermal elements at the occupied end of the thermal head to the erasing position, while moving the ink ribbon to bring the fresh portion used for lift-off erasing to the erasing position for reuse in printing a corrected ink mark at the erasing position.

2. An improved method of lift-off erasing according to claim 1 wherein said ribbon moving means is connected to said carriage moving means when the thermal head is pressed toward the platen such that the ink ribbon is advanced when the carriage is moved forwardly and is rewound when the carriage is moved backwardly, and wherein said first moving step includes moving the thermal head toward the platen for ribbon winding and away from the platen for non-winding in conjunction with moving the carriage forwardly so as to advance a fresh portion of the ink ribbon in front of the thermal head, and then moving the carriage backwardly so as to move said thermal heating elements across the advanced fresh portion for the lift-off erasing operation.

3. In a thermal printer having a platen on which a paper is supported, a carriage mounting a thermal head thereon which is movable forwardly and backwardly along a first direction in parallel with the platen, carriage moving means for moving the carriage forwardly and backwardly along the platen in the first direction, said thermal head being movable toward the platen and away from the platen so as to press the thermal head in contact with the paper in a printing position against the platen and to move the thermal head to a standby position away from the paper, respectively, head moving means for moving the thermal head toward and away from the platen, an ink ribbon provided between the thermal head and the paper on the platen, said ink ribbon having a layer of thermally meltable ink facing the paper and being wound in an ink cartridge supported on the carriage, and ribbon winding means for winding the ink ribbon forwardly to bring a fresh portion of the ribbon to the printing position in conjunction with movement of the carriage forwardly along the platen when the thermal head is in the printing position against the platen, the improvement comprising means for operating said thermal printer to perform lift-off erasing while reducing consumption of the ink ribbon, including:

a thermal head having a length extending in the first direction with an unoccupied end disposed forwardly in the first direction and an occupied end disposed backwardly in the first direction, and thermal heating elements at the occupied end of the thermal head, wherein the ink ribbon has a ribbon portion disposed across the length of the thermal head and is led toward respective parts of the ink cartridge from around the occupied and unoccupied ends of the thermal head;

control means for stopping the forward movement of the thermal head after printing on the paper when it is desired to erase a previously printed ink mark at an erasing position backwardly from the stopped position of the thermal head;

said control means being operated for first moving the thermal head backwardly to the erasing position while providing a fresh portion of the ink ribbon in front of the thermal heating elements at the occupied end of the thermal head;

said thermal heating elements applying heat to the ink ribbon across the erasing position of the previously printed ink mark, so as to thermally melt the ink layer at the fresh portion of the ink ribbon with the previously printed ink mark;

said control means being operated for continuing to move the thermal head backwardly so that the unoccupied portion of the thermal head is moved backwardly of the erasing position without moving the fresh portion relative to the erasing position, during which time the ink layer at the fresh portion is allowed to cool and after which the ink mark becomes adhered to and lifted off from the paper by separation of the ribbon portion from around the unoccupied end of the thermal head; and said control means being operated for finally moving the thermal head forwardly to bring the thermal elements at the occupied end of the thermal head to the erasing position, while moving the ink ribbon to bring the fresh portion used for lift-off erasing to the erasing position for reuse in printing a corrected ink mark at the erasing position.

4. A thermal printer for performing lift-off erasing according to claim 3 wherein said ribbon moving means is connected to said carriage moving means when the thermal head is pressed toward the platen such that the ink ribbon is advanced when the carriage is moved forwardly and is rewound when the carriage is moved backwardly, and wherein said control means is operated for moving the thermal head toward the platen for ribbon winding and away from the platen for non-winding in conjunction with moving the carriage forwardly so as to advance a fresh portion of the ink ribbon in front of the thermal head, and then moving the carriage backwardly so as to move said thermal heating elements across the advanced fresh portion for the lift-off erasing operation.

* * * * *